US005902173A

United States Patent [19]

Tanaka

[11] Patent Number: 5,902,173

[45] Date of Patent: May 11, 1999

[54] POLISHING MACHINE WITH EFFICIENT POLISHING AND DRESSING

[75] Inventor: Katsunori Tanaka, Hamamatsu, Japan

[73] Assignee: Yamaha Corporation, Japan

[21] Appl. No.: 08/820,484

[22] Filed: Mar. 18, 1997

[30] Foreign Application Priority Data

Mar. 19, 1996 [JP] Japan ..... 8-090539

[51] Int. Cl.[6] ..... B24B 29/00

[52] U.S. Cl. ..... 451/56; 451/41; 451/443; 451/287

[58] Field of Search ..... 451/41, 56, 57, 451/63, 285, 286, 287, 288, 289, 443, 444

[56] References Cited

U.S. PATENT DOCUMENTS

| | | | |
|---|---|---|---|
| 4,839,992 | 6/1989 | Ishida et al. . | |
| 5,010,692 | 4/1991 | Ishida et al. . | |
| 5,384,986 | 1/1995 | Hirose et al. | 451/444 |
| 5,486,131 | 1/1996 | Cesna et al. | 451/56 |
| 5,569,062 | 10/1996 | Karlsrud | 451/56 |
| 5,626,509 | 5/1997 | Hayashi | 451/443 |
| 5,681,212 | 10/1997 | Hayakawa et al. | 451/288 |

FOREIGN PATENT DOCUMENTS

| | | |
|---|---|---|
| 4-364730 | 12/1992 | Japan . |
| 7-237120 | 9/1995 | Japan . |
| 7-299731 | 11/1995 | Japan . |

*Primary Examiner*—Eileen P. Morgan
*Attorney, Agent, or Firm*—Ostrolenk, Faber, Gerb & Soffen, LLP

[57] ABSTRACT

A dresser for dressing a polishing cloth adhered to a platen is provided with different dressing tools such as a lapping tool and a brush disposed around the lapping tool. In polishing, the platen is rotated and a wafer holding unit sucks and holds a wafer to press it against the polishing cloth while the wafer is rotated. In this manner, while polishing is performed, dressing is performed at the same time by pressing the dressing tools of the dresser against the polishing cloth. The brush and lapping tool may be rotated independently, or the dresser may be swung while it is rotated.

17 Claims, 16 Drawing Sheets

POLISHING MACHINE WITH EFFICIENT POLISHING AND DRESSING

BACKGROUND OF THE INVENTION

This application is based on Japanese patent application No. 8-90539 filed on Mar. 19, 1996, the entire contents of which are incorporated herein by reference.

a) Field of the Invention

The present invention relates to a polishing machine for polishing a subject such as a semiconductor wafer, and more particularly to a polishing machine having a dresser for dressing a polishing cloth.

b) Description of the Related Art

A polishing process is performed, for example, in order to planarize the interlayer insulating film formed on the surface of a semiconductor wafer. A known conventional polishing machine polishes a wafer by pressing it to a polishing cloth which is fixed to a rotary platen.

As the number of wafers polished with such a polishing machine increases, the polishing cloth is filled or choked up with polishing agent, scraped-off particles and the like. The polishing cloth may be deformed or abraded by rotation or load of wafers. With these reasons, the polishing performance may be degraded such as lowering a polishing speed, and a wafer may be damaged or contaminated.

A dressing function of reconditioning a polishing cloth choked up with foreign materials has been added to a polishing machine (refer to JP-A-4-364730 and JP-A-7-254578).

FIGS. 12 to 19 illustrate an example or a conventional polishing method for a polishing machine having a dressing function. A polishing machine 10 has a platen 12 to the surface of which a polishing cloth is adhered and a wafer receptacle 14 mounted near the platen 12. As shown in FIG. 19, a dresser 24 held by a dresser holder 22 is movably mounted on the polishing machine 10. This dresser 24 is not shown in FIGS. 12 to 18 for drawing simplicity. As a dressing tool of the dresser 24, one of a wire brush, a resin brush, a diamond disk conditioner and the like is used.

As shown in FIG. 20, a wafer holder 18 can hold a wafer 18 at the inside of a guide 26, by a vacuum chuck or the like, and is made movable so that the wafer holder 18 can press the wafer 18 against the polishing cloth on the platen 12 while being rotating by its rotary shaft 28.

At the process shown in FIG. 12, a subject wafer 16 is placed on the wafer receptacle 14, and at the process shown in FIG. 13 the wafer 16 is sucked by a vacuum chuck and held by the wafer holder 18.

Next, at the process shown in FIG. 14, the wafer holder 18 holding the wafer 16 is moved to the central area of the platen 12. At the process shown in FIG. 15, the wafer holder 18 is lowered to press the wafer 16 against the polishing cloth on the rotating platen 12. Polishing agent is supplied from a dispensing nozzle 20 onto the platen 12. The wafer 16 rotated and held by the wafer holder 18 and pressed against the polishing cloth is therefore polished.

After polishing, at the process shown in FIG. 16 the wafer holder 18 raises the wafer 16 from the platen 12. At the process shown in FIG. 17, the wafer holder 18 holding the wafer 16 is moved to the wafer receptacle 14 and unloads the wafer 16 down into the wafer receptacle 14 through release of suction by the vacuum chuck or through application of water pressure.

At the process shown in FIG. 18, the wafer holder 18 is moved to the initial position. At the process shown in FIG. 19, the dresser holder 22 moves the dresser 24 to the area over the platen 12. Thereafter, the dressing tool of the dresser 24 is pressed against the polishing cloth on the rotating platen 12 to dress the polishing cloth while the dresser 24 is rotated. In this case, cleaning liquid such as pure water may be supplied from an unrepresented pipe to clean the polishing cloth.

After dressing, the process returns to the process shown in FIG. 12 to execute a polishing process for the next wafer in the manner described above. Dressing may be performed after a plurality of wafers are polished, not by performing it each time a single wafer is polished.

The following properties (1) to (4) are generally required for dressing.

(1) brushing or lapping away choked foreign materials in polishing cloth (lapping)

(2) removing foreign materials on polishing cloth (surface cleaning)

(3) providing plastic deformation for elastic polishing cloth or other cloths (pressing)

(4) raising naps of fibered polishing cloth or other cloths (uniforming)

Various kinds of dressing tools have been proposed. However, none of them can satisfy the requirements of the properties (1) to (4) at the same time, and only one or more properties can be provided.

For example, if a diamond disk conditioner having a large abrading ability is used as a dressing tool, scraped-off polishing cloth fibers and diamond grains are Left on the polishing cloth so that the wafer may be damaged or contaminated. If a dressing tool having no cleaning ability is used, contaminated polishing agent is supplied to the subject wafer during dressing.

Furthermore, since the conventional dressing process is performed independently from the polishing process, throughput of both the processes is lowered if the polishing performance is not stable.

SUMMARY OF THE INVENTION

It is an object of the present invention to provide a polishing machine capable of providing efficient dressing without increasing an area to be occupied by a dresser.

According to one aspect of the present invention, there is provided a method of polishing a subject, comprising the steps of: a) providing the subject retained by a holder; b) providing a dresser means having different dressing portions provided coaxially; c) polishing the subject by causing the subject to be held in contact with a polishing cloth provided on a platen; and d) dressing the polishing cloth by causing the dresser means to be held in contact therewith.

According to another aspect of the present invention, there is provided a polishing machine comprising: a platen having a polishing cloth adhered thereto and being rotatable; holding means for holding a subject to be polished and pressing the subject against the polishing cloth of the platen under rotation; and dressing means for holding a dresser and pressing the dresser against the polishing cloth of the platen under rotation while rotating the dresser, the dresser having different dressing tools disposed concentrically.

Since a dresser is coaxially provided with different dressing tools, efficient dressing can be realized. For example, with a diamond disk conditioner and a brush, both abrading and surface cleaning are achieved.

Since different dressing tools are provided coaxially on a dresser, an area of the platen occupied by the dresser can be reduced more than to provide different dressing tools on different dressers.

If dressing is performed by rotating and swinging the dresser, uniformity of dressing can be improved.

Further, if dressing and polishing are performed at the same time, a polishing performance becomes stable and throughput of both the polishing and dressing can be improved.

Still further, if different dressing tools are rotated independently, a fine dressing control becomes possible.

DETAILED DESCRIPTION OF THE PREFERRED EMBODIMENTS

Figure 1:
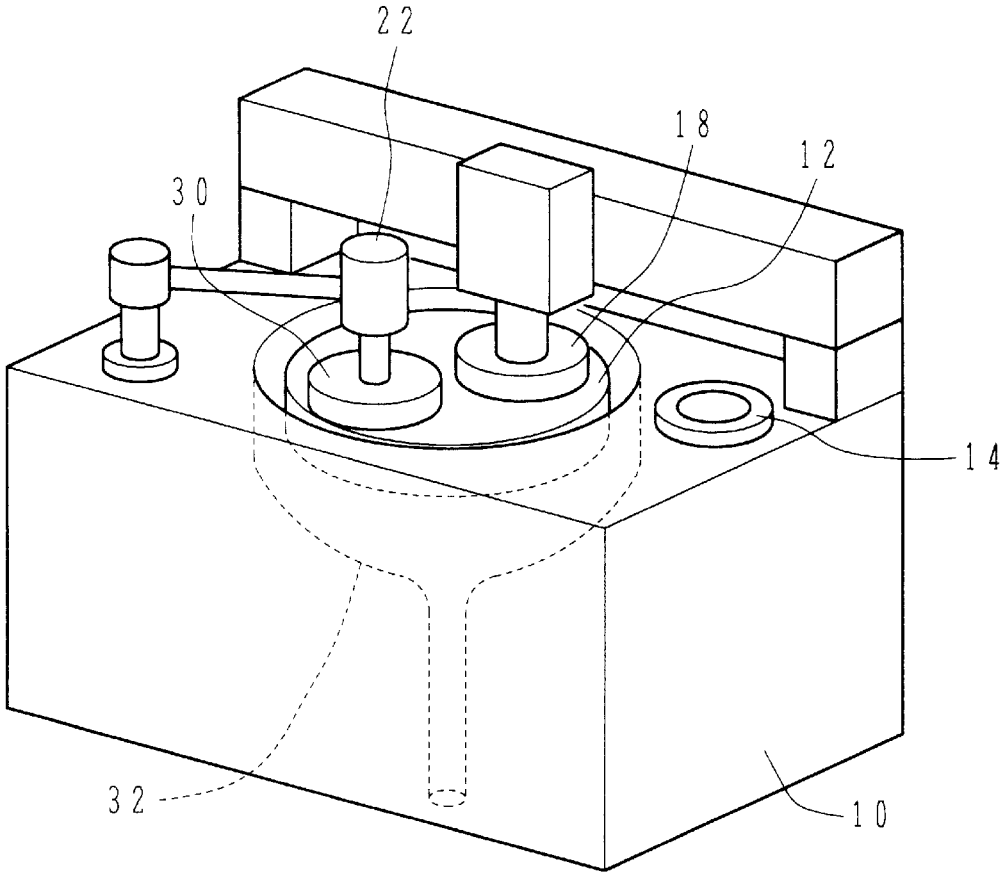
FIG. 1 is a perspective view of a polishing machine according to an embodiment of the invention.
Figure 2:
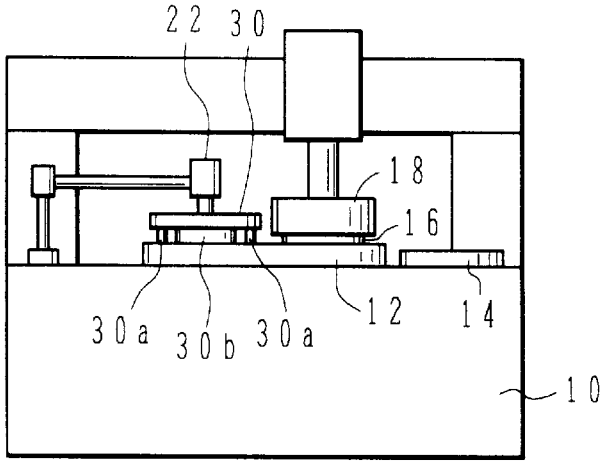
FIG. 2 is a side view illustrating a wafer polishing process by the machine shown in FIG. 1.
Figure 3:
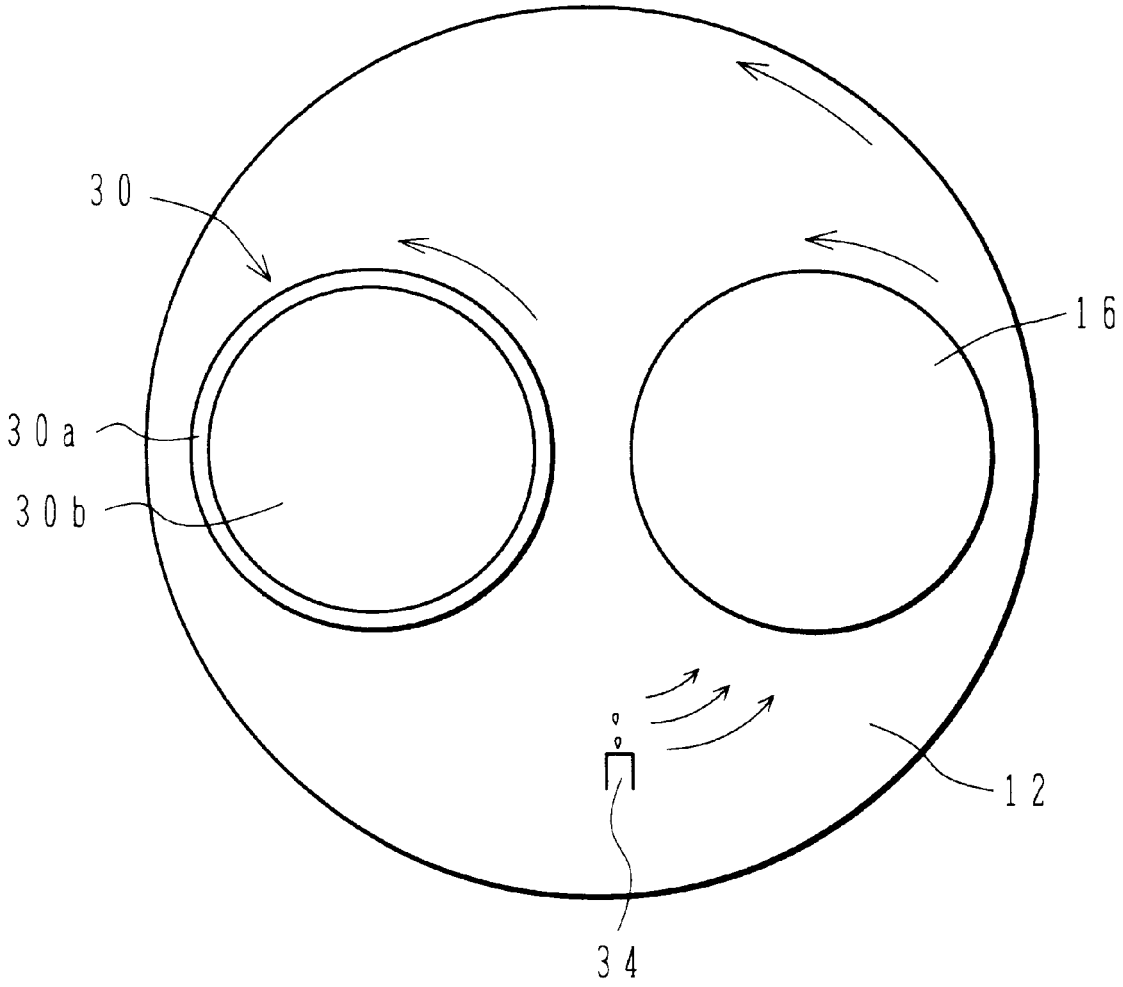
FIG. 3 is a plan view showing the positions of a dresser and a wafer on a platen.
Figure 4:
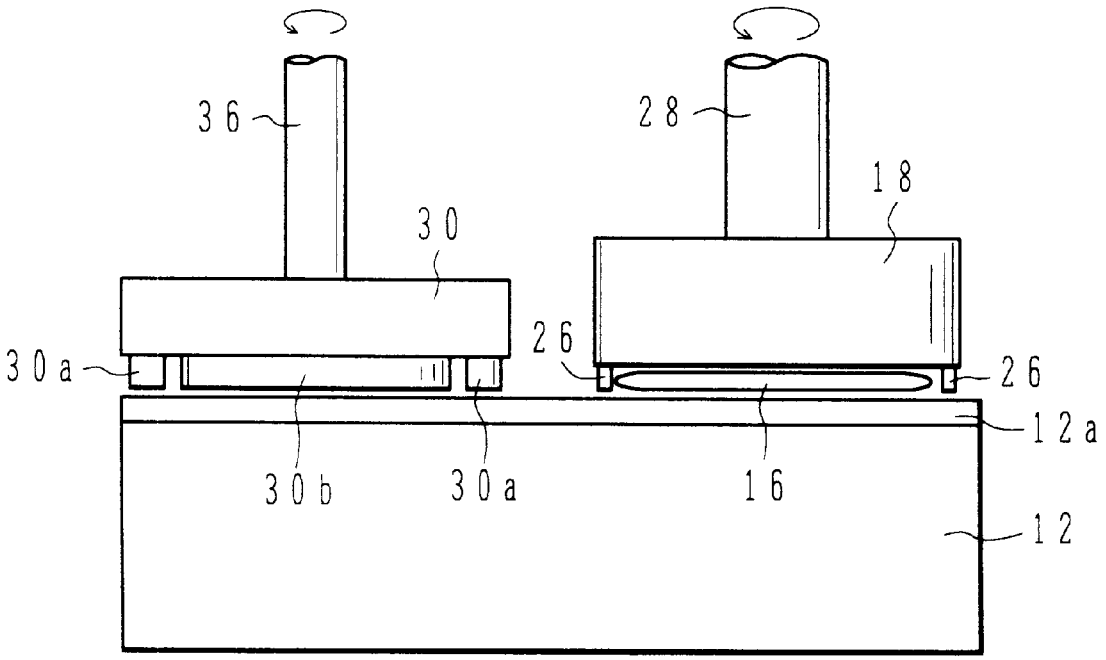
FIG. 4 is a cross sectional view illustrating the configuration of a dresser and a wafer on a platen.
Figure 5:
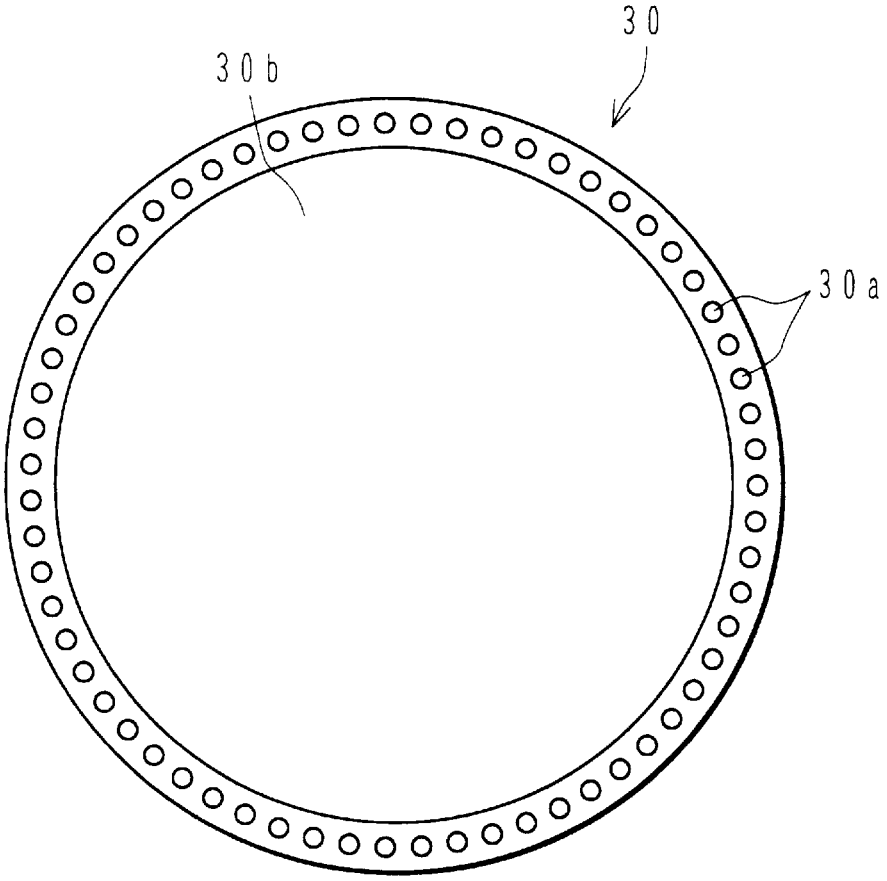
FIG. 5 is a bottom view showing the positions of dressing tools of a dresser.
Figure 6:
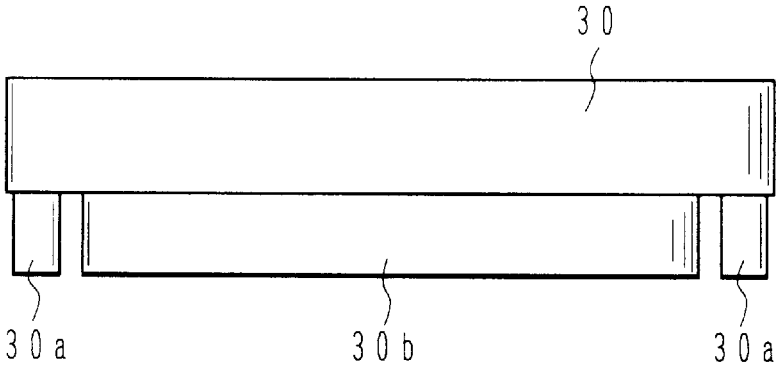
FIG. 6 is a cross sectional view illustrating the configuration of the dressing tools of the dresser shown in FIG. 5.

FIG. 1 shows a polishing machine according to the first embodiment of the invention, and FIGS. 2 to 4 illustrate a polishing method using the polishing machine shown in FIG. 1.

As shown in FIG. 4, a polishing machine 10 has a platen 12 to the surface of which a polishing cloth 12*a* is adhered. The platen 12 is rotated, for example, by a motor in the direction indicated by an arrow shown in FIG. 3. A wafer receptacle 14 for retaining a wafer to be polished is mounted near the platen 12.

A wafer holder 18 retains a wafer 16 at the inside of a guide 26, by a vacuum chuck or the like similar to the method described with FIGS. 12 to 20, and is made movable while holding the wafer 16. As shown in FIG. 4, the wafer holder 18 presses the wafer 16 against the polishing cloth on the platen 12 while being rotating by its rotary shaft 28.

Figure 24A:
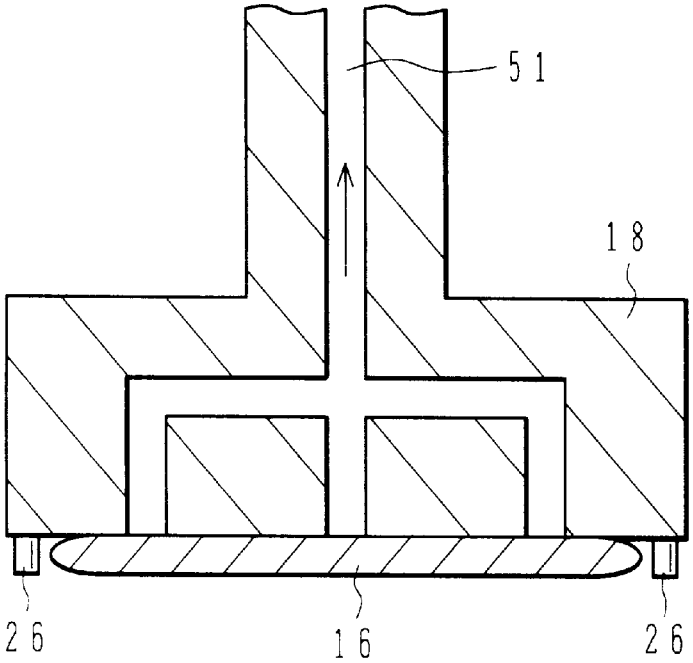
FIGS. 24A to 24D are cross sectional views of wafer holders.

FIG. 24A is a cross sectional view of the wafer holder 18. The wafer holder 18 has a cavity 51 therein. As the inside of the cavity 51 is evacuated, the wafer 16 is sucked upward toward the cavity 51 and attached to the bottom of the wafer holder 18 at the inside of the guide 26.

Figure 24B:
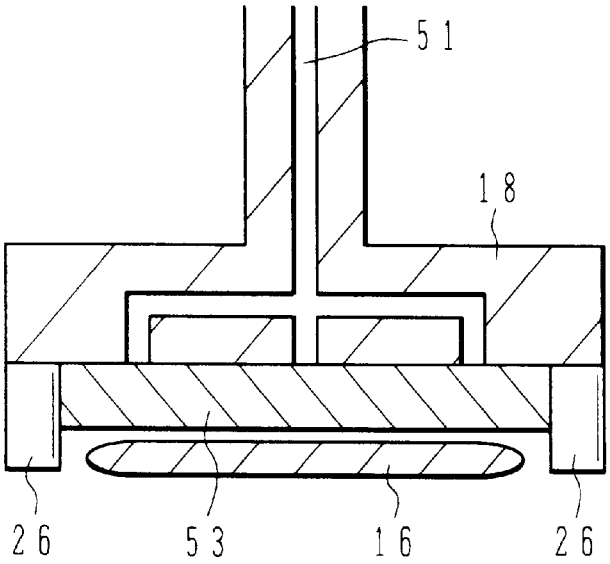
Figure 24C:
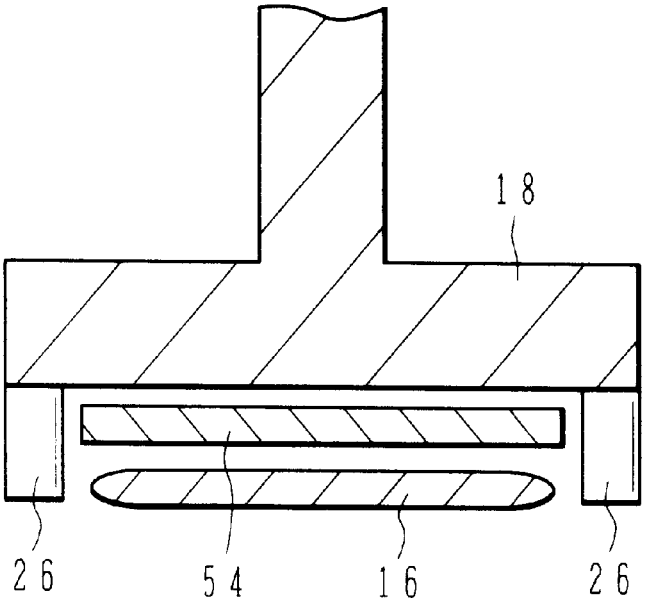
Figure 24D:
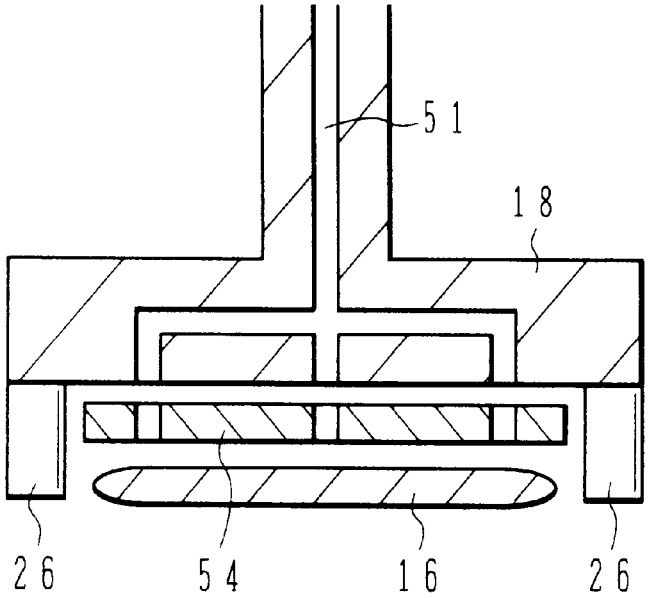

FIGS. 24B to 24D are cross sectional views of the other wafer holders 18. As shown in FIG. 24B, the wafer holder 18 sucks the wafer 16 through a porous ceramic 53 by evacuating the cavity 51. As shown in FIG. 24C, a backing pad 54 is fixed to the bottom of the wafer holder 18. The backing pad 54 wetted sucks the wafer 16 by water chuck. As shown in FIG. 24D, the wafer holder 18 has the cavity 51 and the backing pad 54. The wafer 16 is sucked by vacuum chuck and water chuck.

As shown in FIGS. 1 and 2, a dresser 30 held by a dresser holder 22 is provided which is movable in the horizontal and vertical directions relative to the surface of the platen 12. As shown in FIGS. 2 to 6, the bottom of the dresser 30 is provided with two dressing tools, one being a circle lapping tool 30*b* and the other being a brushing tool 30*a* positioned around the circle lapping tool 30*a*. The lapping tool 30*b* and brush 30*a* are disposed concentrically with a rotary shaft (self rotation shaft) of a head on which the dresser 30 is mounted. The brush 30*a* may be a wire brush, a resin brush, or the like. The lapping tool 30*b* may be a diamond disk conditioner or the like.

Figure 7:
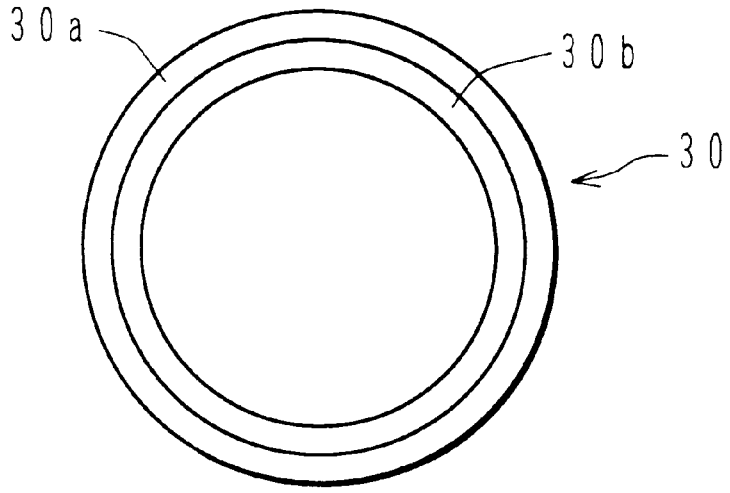
FIG. 7 is a bottom view showing a modification of the positions of dressing tools of a dresser.
Figure 8:
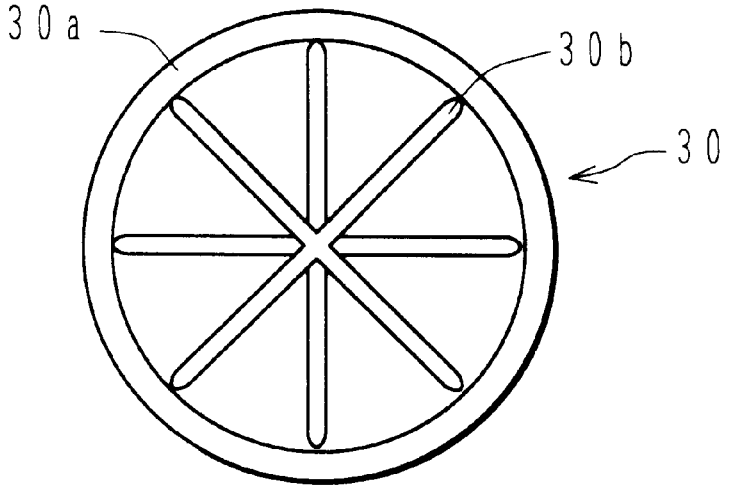
FIG. 8 is a bottom view showing another modification of the positions of dressing tools of a dresser.

The lapping tool 30*b* may be a ring lapping tool such as shown in FIG. 7 or a radial lapping tool such as shown in FIG. 8.

The polishing machine 10 has a drain unit 32 which surrounds the platen 12 and extends out of the machine to drain used polishing agent and scraped-off particles.

Similar to the polishing processes described with FIGS. 12 to 15, the wafer holder 18 transfers the wafer 16 from the wafer receptacle 14 to the platen 12. The wafer 16 held and rotated by the wafer holder 18 is pressed against the polishing cloth 12*a* on the platen 12 with a predetermined force, and polished. The wafer 16 is not necessarily rotated by the wafer holder 18 during the polishing.

It is better that the platen 12 and the wafer holder 18 are generally the same rotation speed. It is mathematically proved that the wafer 16 rubs on the polishing cloth 12*a* at the same speed everywhere, if the platen 12 and the wafer holder 18 are the same rotation speed. The wafer 16 was uniformly polished by rotating the platen 12 and the wafer holder 18 both at the same rotation speed in an experiment.

During the polishing, polishing agent is dispensed from a dispensing nozzle 34 onto the polishing cloth 12*a* on the platen 12 as shown in FIG. 3. Slurry is used as polishing agent, which is a mixture of chemical base, abrasive, and fluid. The surface of the wafer 16 in press contact with the platen 12 with a predetermined force is chemically eroded by chemicals contained in the polishing agent and mechanically abraded by abrasive contained in the polishing agent.

Figure 16:
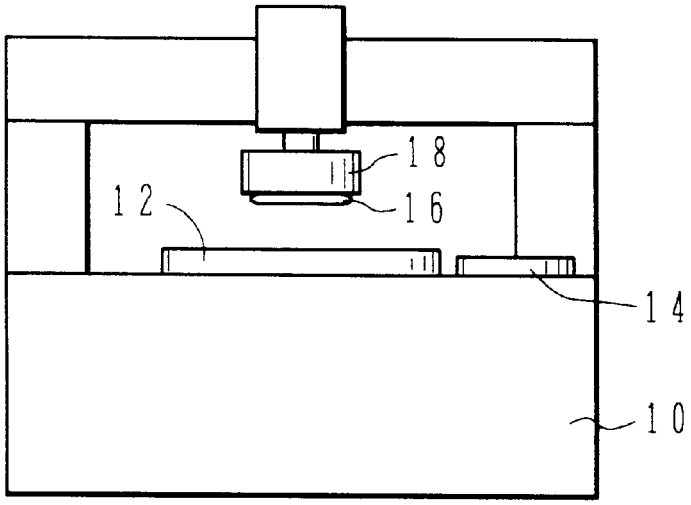
FIG.16 PRIOR ART
FIG. 16 is a side view illustrating a wafer lifting process after the process of FIG. 15.
Figure 17:
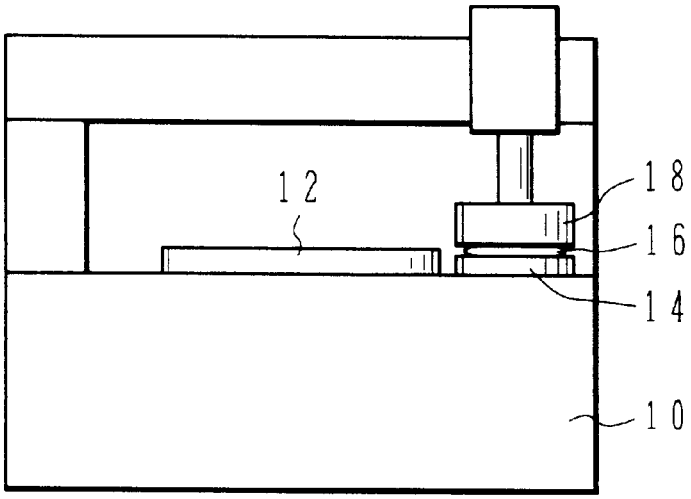
FIG.17 PRIOR ART
FIG. 17 is a side view illustrating a wafer dismounting process after the process of FIG. 16.
Figure 18:
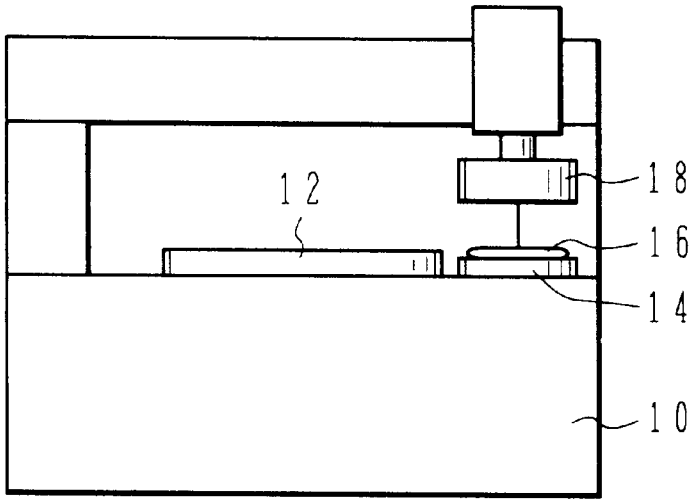
FIG.18 PRIOR ART
FIG. 18 is a side view illustrating a wafer holder returning process after the process of FIG. 17.

Similar to the processes shown in FIGS. 16 to 18, after the polishing, the wafer holder 18 holding the wafer 16 is moved to the wafer receptacle 14, unloads the wafer 16 down into the wafer receptacle 14, and is moved to the initial position.

Figure 24E:
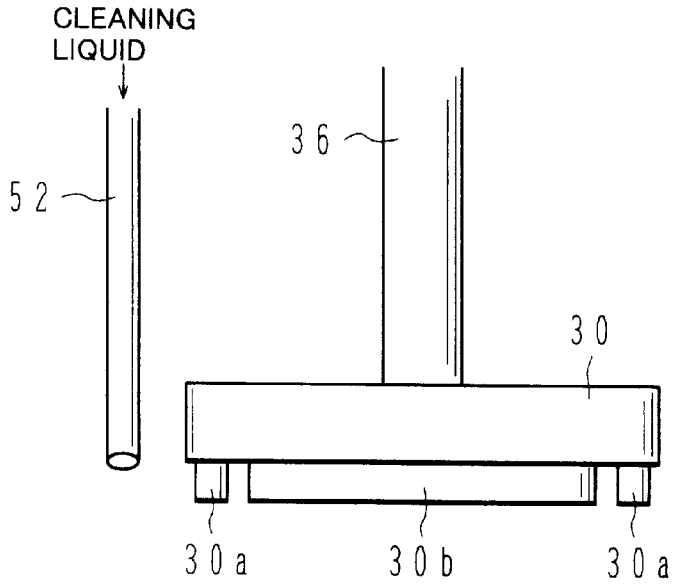
FIGS. 24E and 24F are cross sectional views of dressers.
Figure 24F:
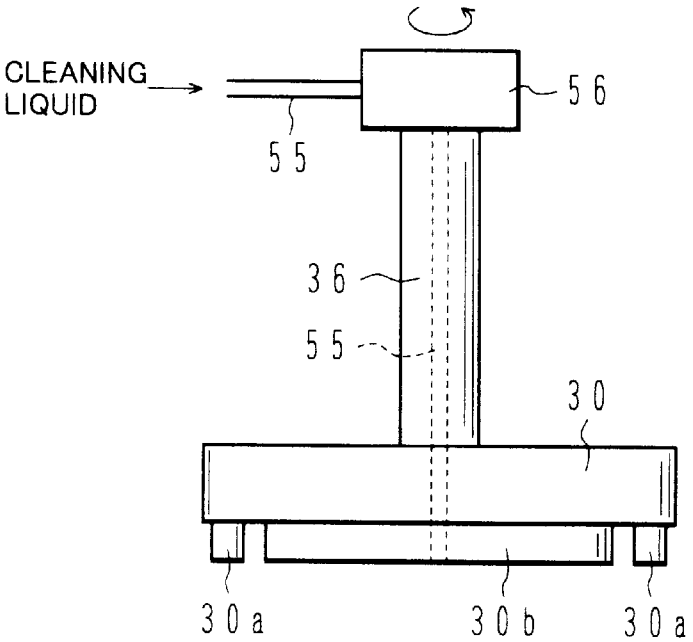

For the dressing processes, as shown in FIGS. 1 to 4, the dresser holder 22 moves the dresser 30 to the area over the rotating platen 12, and the dresser 30 under rotation is pressed against the polishing cloth 12*a* on the rotating platen 12. In this case, appropriate cleaning liquid may be supplied from a pipe 52 shown in FIG. 24E onto the platen 12 to clean the polishing cloth 12*a*. FIG. 24F shows another pipe 55 to supply cleaning liquid. The rotary shaft 36 of the dresser 30 has the pipe 55 inside. Cleaning liquid may be supplied from the pipe 55 onto the platen 12 through a rotary joint 56.

Figure 19:
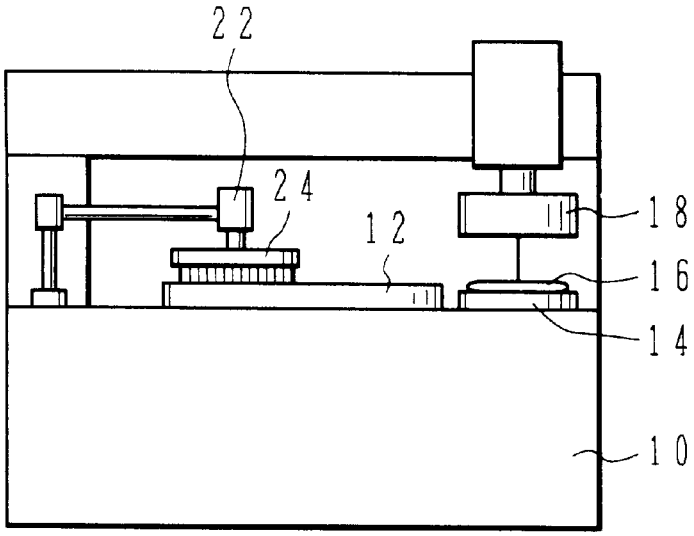
FIG.19 PRIOR ART
FIG. 19 is a side view illustrating a polishing cloth dressing process after the process of FIG. 18.
Figure 20:
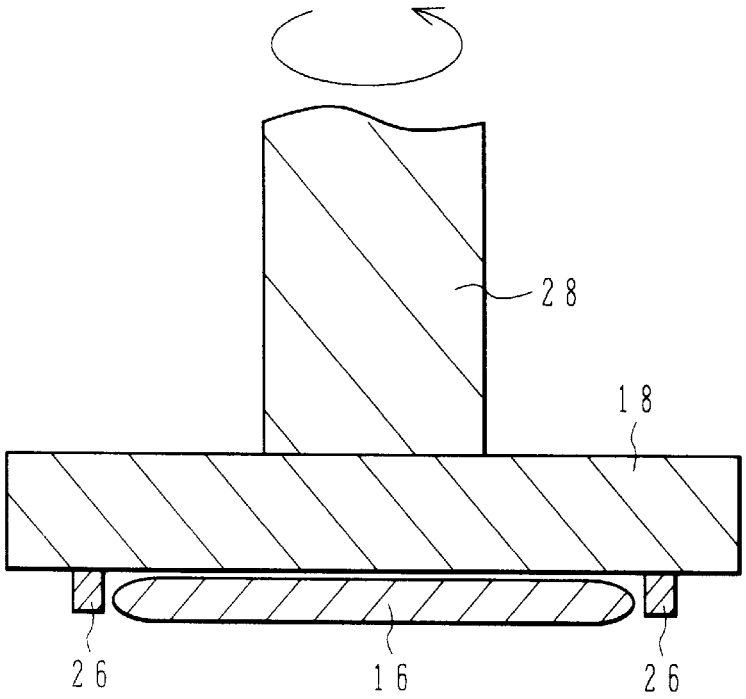
FIG.20 PRIOR ART
FIG. 20 is a cross sectional view of a conventional wafer holder.

Dressing may be performed after a plurality of wafers are polished or each time a single wafer is polished, as stated earlier with FIGS. 12 to 19. Alternatively, dressing may be performed at the same time when polishing is performed. Specifically as shown in FIGS. 1 to 4, both the wafer 16 and dresser 30 are juxtaposed on the platen 12 by the wafer holder 18 and dresser holder 22. As shown in FIG. 3, while polishing agent is supplied from the dispensing nozzle 34 onto the platen 12, the platen 12, wafer 16, and dresser 30 are rotated in the directions indicated by arrows in FIGS. 3 and 4 to perform both the polishing and dressing at the same time. Since dressing is performed during polishing, a stable polishing performance is achieved and an independent polishing process shown in FIG. 19 is not necessary, so that throughput can be improved.

Furthermore, even during wafer polishing, the polishing cloth is reconditioned with the dressing tools. It is therefore possible to prevent the polishing cloth from being filled or choked up with polishing agent and scraped-off particles and to polish a wafer always in a clean state and shorten a polishing time.

With the above-described dressing process, both lapping and surface cleaning can be efficiently performed. Namely, as the dresser 30 is rotated on the rotating platen 12 as shown in FIG. 3, lapping can be performed uniformly on the polishing cloth 12*a*. Foreign particles such as diamond particles dropped away from the lapping tool 20*b* and scraped-off particles of the polishing cloth 12*a* can be removed by the brush 30*a* and drained from the drainage unit 32 shown in FIG. 1.

New polishing agent is always dispensed from the dispensing nozzle 34 onto the platen 12 as shown in FIG. 3 during the wafer polishing while the dressing is performed, and used polishing agent is removed by the brush 30*a* and drained from the drain unit 32 shown in FIG. 1. Therefore, stable polishing is possible.

A combination of different dressing tools of the dresser 30 is preferably selected in accordance with the use object. A combination of lapping nature and pressing nature (e.g., alumina ceramic plate), a combination of pressing nature and surface cleaning nature, and other combinations may be used in addition to the combination of lapping nature and surface cleaning nature described above.

Figure 9:
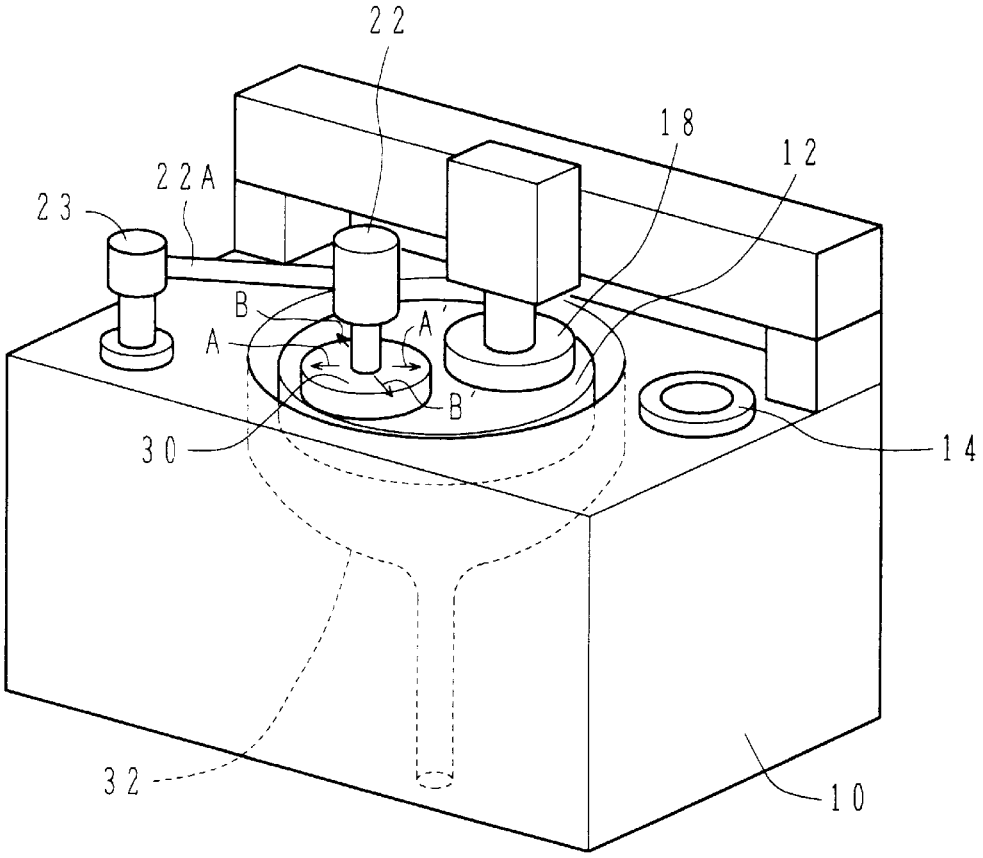
FIG. 9 is a perspective view of a polishing machine according to another embodiment of the invention.
Figure 10:
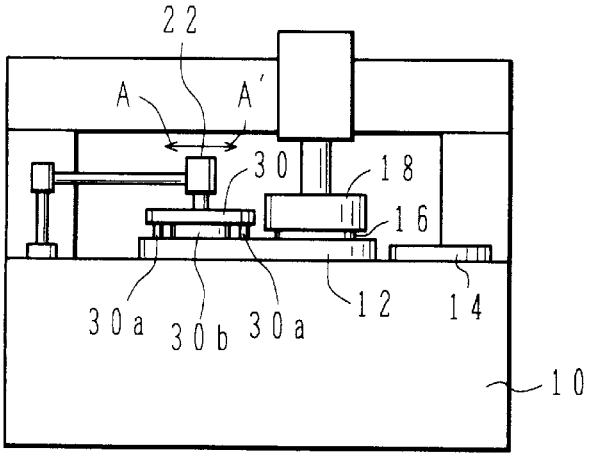
FIG. 10 is a side view illustrating a wafer polishing process by the machine shown in FIG. 9.

FIG. 9 shows a polishing machine according to another embodiment of the invention. FIG. 10 illustrates a wafer polishing process using the machine shown in FIG. 9. In FIGS. 9 and 10, like elements to those shown in FIGS. 1 and 2 are represented by using identical reference numerals and the description thereof is omitted.

The feature of this embodiment shown in FIGS. 9 and 10 resides in that the dresser 30 in press contact with the polishing cloth on the platen 12 is swung in A–A' direction and B–B' direction while it is rotated to dress the polishing cloth. In operation of the polishing machine of this embodiment, similar to the operations described with FIGS. 1 to 4, the platen 12 is rotated during dressing which may be performed independently or together with polishing.

In order to swing the dresser 30, an arm 22A with the dresser holder 22 mounted at its distal end may be mounted on a support 23 in such a manner as allowing it to rotate and reciprocate relative to the support 23. With this structure, the dresser holder 11 can be driven in A–A' and B–B' directions, for example, with cylinders.

This structure shown in FIGS. 9 and 10 further improves dressing uniformity over the whole surface of the platen 12, than the structure shown in FIGS. 1 and 2.

Figure 11:
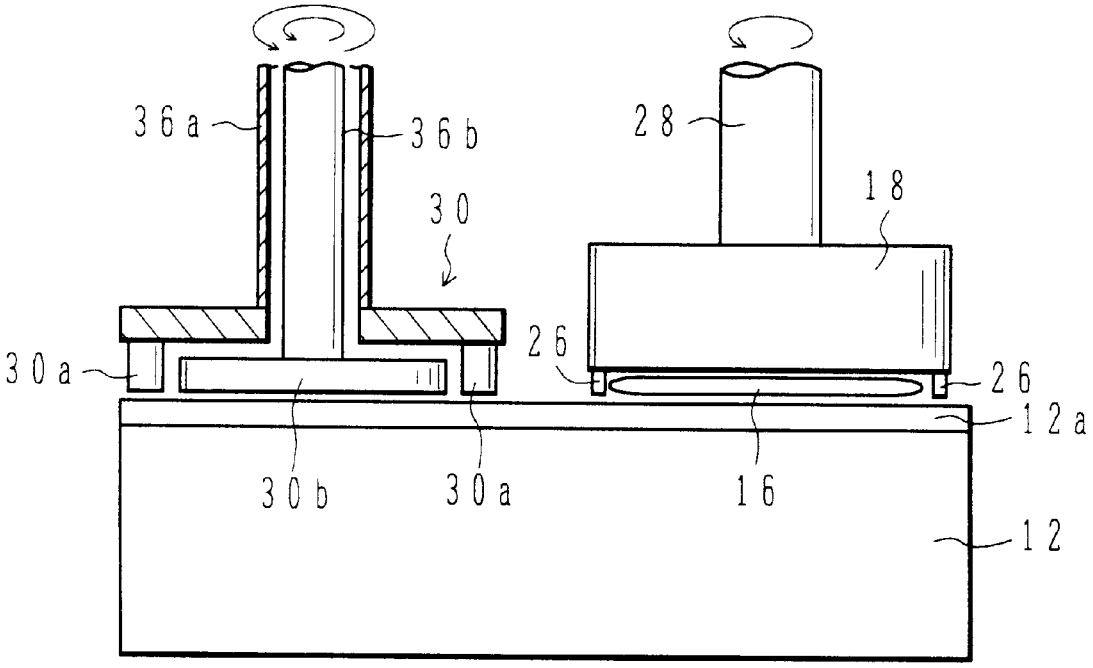
FIG. 11 is a cross sectional view of polishing/dressing units of a polishing machine according to a further embodiment of the invention.
Figure 12:
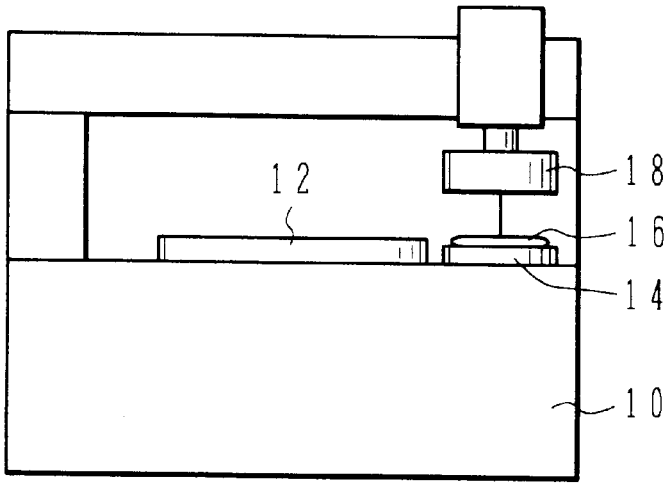
FIG.12 PRIOR ART
FIG. 12 is a side view illustrating a wafer mount process according to a conventional polishing method.
Figure 13:
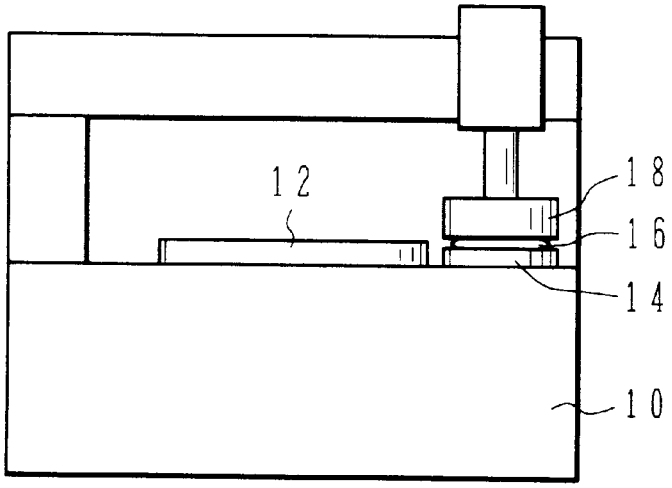
FIG.13 PRIOR ART
FIG. 13 is a side view illustrating a wafer holding process after the process of FIG. 12.
Figure 14:
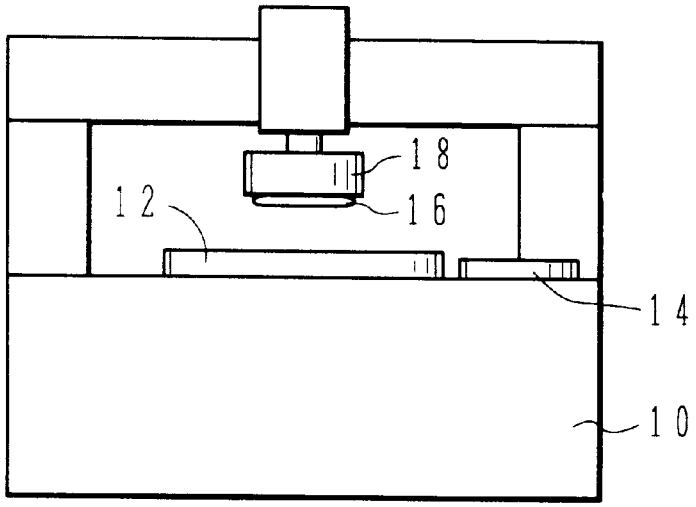
FIG.14 PRIOR ART
FIG. 14 is a side view illustrating a wafer transport process after the process of FIG. 13.
Figure 15:
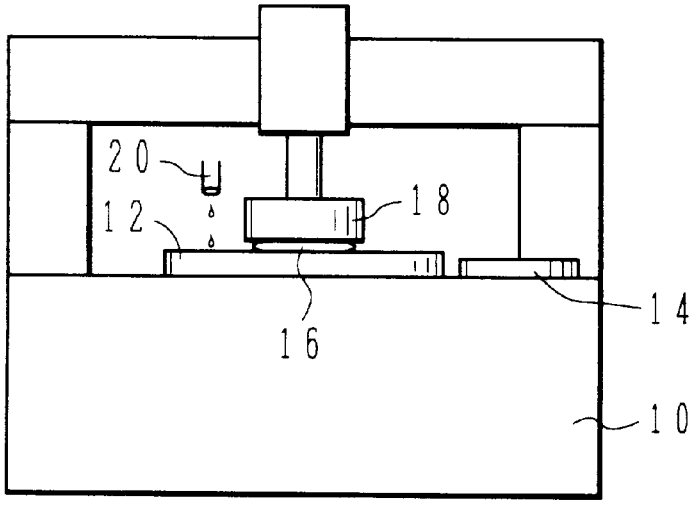
FIG.15 PRIOR ART
FIG. 15 is a side view illustrating a wafer lowering and polishing process after the process of FIG. 14.

FIG. 11 shows the structure of polishing/dressing units of a polishing machine according to a further embodiment of the invention. In FIG. 11, like elements to those shown in FIG. 4 are represented by using identical reference numerals and the description thereof is omitted.

The feature of this embodiment shown in FIG. 11 resides in that the brush 30*a* and lapping tool 30*b* of the dresser 30 are rotated independently. Namely, the brush 30*a* is rotated by a rotary shaft 36*a* and the lapping tool 30*b* is rotated by a rotary shaft 36*b* disposed coaxially with the rotary shaft 36*a*.

This structure shown in FIG. 11 allows the brush 30*a* and lapping tool 30*b* to rotate at optimum speeds to dress the polishing cloth. The structure of FIG. 11 may be applied not only to the machine shown in FIG. 1 but also to the machine shown in FIG. 9.

The rotary shaft 36*a* of the brush 30*a* may be made movable up and down so that surface cleaning can be performed at desired periods while the brush 30*a* is lowered.

Figure 21:
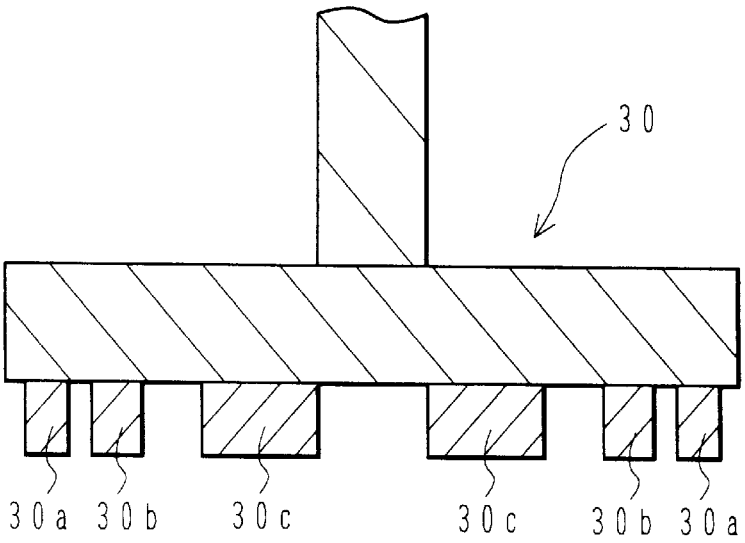
FIG. 21 is a cross sectional view of a dresser having three kinds of dressing tools.

In the above embodiments, two different dressing tools (brush 30*a* and lapping tool 30*b*) are mounted on the dresser 30. Instead, as shown in FIG. 21, three different dressing tools 30*a*, 30*b*, and 30*c* may be mounted on the dresser 30. Similarly, four or more different types of dressing tools may be mounted on the dresser 30. The dresser 30 can rotate two or more types of dressing tools coaxially.

Figure 22:
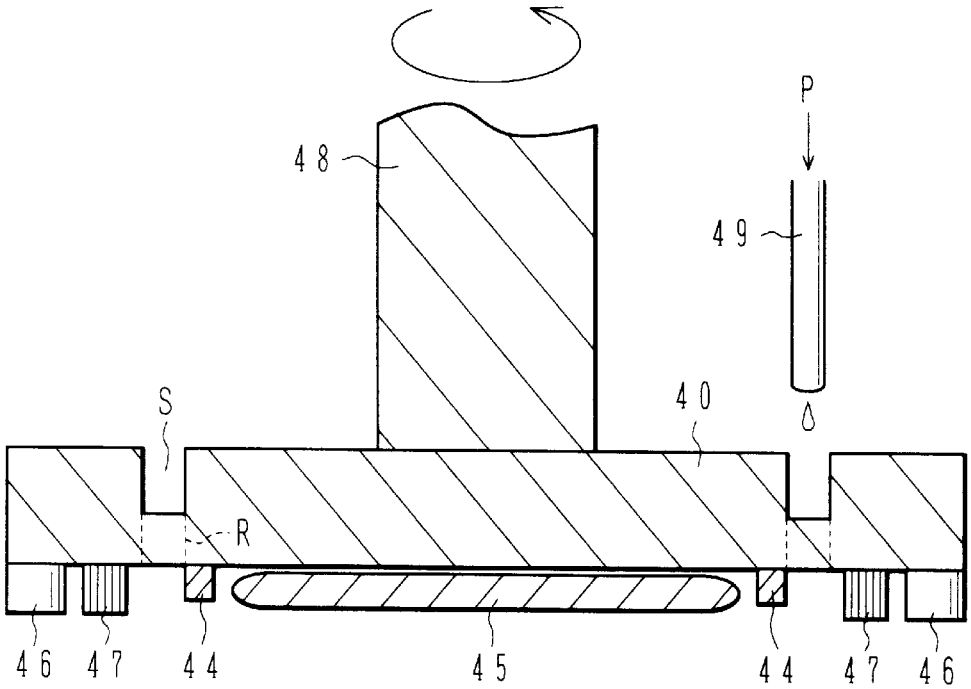
FIG. 22 is a cross sectional view of a tool/wafer holder.

FIG. 22 is a cross sectional view of a tool/wafer holder. The tool/wafer holder 40 has an integrated structure of a dresser 30 and a wafer holder 18.

Similar to the wafer holder 18, the tool/wafer holder 40 can hold a wafer 45 at the inside of a guide 44, by a vacuum chuck or the like, and is made movable while holding the wafer 45. The tool/wafer holder 40 presses the wafer 45 against the polishing cloth on the platen 12 (FIG. 1) while being rotating by its rotary shaft 48.

At the outer peripheral area of the tool/wafer holder 40 or at the outer area of the guide 44 thereof, a brush 47 and a lapping tool 46 respectively of a ring shape are concentrically provided, the lapping tool 46 being positioned outside of the brush 47. The lapping tool 46 may be a diamond disk conditioner. Depending upon the use object, in place of, or in addition to, the lapping tool 46 and brush 47, other dressing tools such as ceramic plate may be used.

A ring groove S open to the upper surface of the tool/wafer holder 40 is formed in the holder 40 at the position between the guide 44 and brush 47. A number of holes R are formed in the groove, opening to the bottom surface of the holder 40. Polishing agent P from a dispensing nozzle 47 can be supplied to the wafer 45 through the groove S and holes R without being interrupted by the dressing tools including the lapping tool 46 and brush 47. Reliable wafer polishing is therefore possible.

Similar to the polishing processes described with FIGS. 12 to 15, the tool/wafer holder 40 transfers the wafer 45 from the wafer receptacle 14 to the platen 12. The wafer 45 held and rotated by the tool/wafer holder 40 is pressed against the polishing cloth 12*a* on the platen 12 to polish it.

During the polishing, polishing agent P is dispensed from a dispensing nozzle 34 via the groove S and holes R onto the polishing cloth 12*a* and wafer 45 as shown in FIG. 22. Since the lapping tool 46 is rotated and pressed against the polishing cloth 12*a*, the polishing cloth 12*a* is subjected to dressing of lapping nature. The outer lapping tool 46 laps away foreign particles filled in the polishing cloth 12*a*, whereas the inner brush 47 moves away scraped-off particles so as not to move them toward the wafer 45.

Similar to the processes shown in FIGS. 16 to 18, after the polishing, the tool/wafer holder 40 holding the wafer 45 is moved to the wafer receptacle 14, unloads the wafer 45 down into the wafer receptacle 14, and is moved to the initial position.

With this polishing machine, the area of the platen 12 occupied by the dresser can be reduced as compared to the embodiment shown in FIG. 11. Since the holding, rotating, and transferring mechanism of the dresser is used in common with the wafer holder, the structure of the machine becomes simple. Since dressing a polishing cloth is performed during polishing, a stable polishing performance is achieved and an independent polishing process shown in FIG. 19 is not necessary, so that throughput can be improved.

The tool/wafer holder 40 shown in FIG. 22 uses a combination of different dressing tools of lapping nature (lapping tool 46) and surface cleaning nature (brush 47). A combination of different dressing tools is preferably selected in accordance with the use object, such as a combination of lapping nature and pressing nature (e.g., alumina ceramic plate), a combination of pressing nature and surface cleaning nature, and other combinations. A combination of three or more different kinds of dressing tools may be selected.

Figure 23:
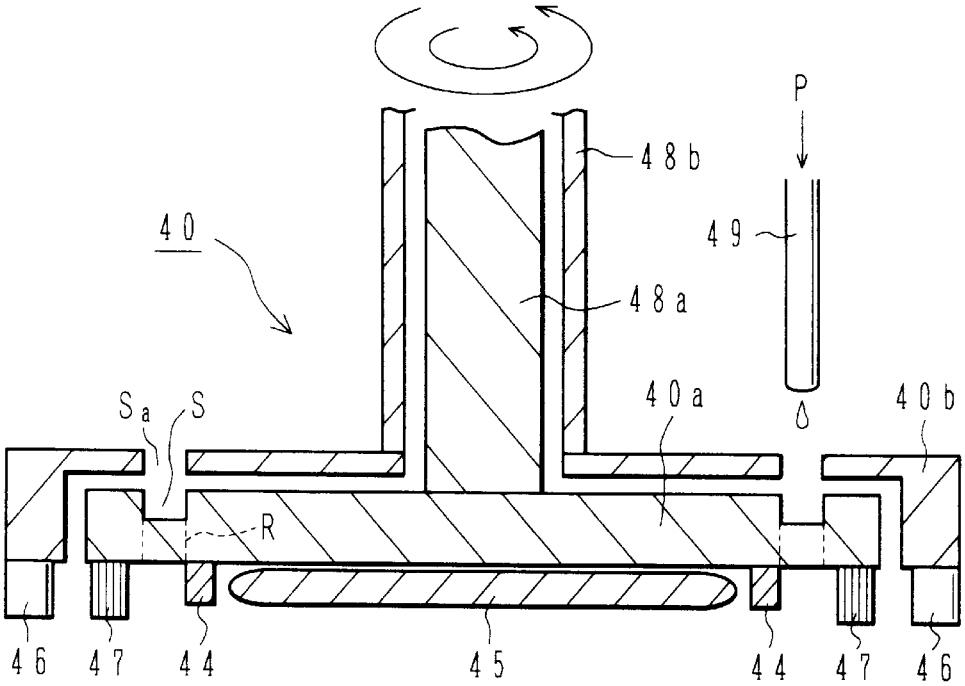
FIG. 23 is a cross sectional view of another tool/wafer holder.

FIG. 23 shows another tool/wafer holder. In FIGS. 23, like elements to those shown in FIG. 22 are represented by using identical reference numerals.

The feature of the tool/wafer holder 40 shown in FIG. 23 is that a tool holder unit 40*b* with a lapping tool 46 is rotated independently from a wafer holder unit 40*a* with a brush 47. Specifically, the lapping tool 46 is adhered to the bottom of the tool holder unit 40*b* which is mounted covering the wafer holder 40*b*, whereas the brush 47 is adhered to the bottom of the wafer holder unit 40*a*. The tool holder unit 40*b* is rotated by a rotary shaft 48*b* disposed coaxially with, and outside of, a rotary shaft 48*a* for rotating the wafer holder unit 40*a*. A groove Sa is formed in the tool holder unit 40*b*, and a groove S corresponding in position to the groove Sa is formed in the wafer holder unit 40*a*. A number of holes R are formed in the groove S, opening to the bottom surface of the wafer holding tool 40*a*. Polishing agent P can be supplied therefore from a dispensing nozzle 49 to the wafer 45 via the grooves Sa and S and holes R.

With the structure shown in FIG. 23, dressing by the lapping tool 46 can be performed at an optimum rotation speed. Although the lapping tool 46 is rotated independently from the wafer holder unit 40*a* in the example of FIG. 23, the lapping tool 46 and brush 47 may be rotated independently from the wafer holder unit 40*a*. Alternatively, the brush 47 may be rotated independently from the lapping tool 46 and wafer holder unit 40*a*. Namely, different dressing tools and the wafer holder unit may be rotated independently from each other. In other words, dressing can be performed by rotating the lapping tool 46 and brush 47 at optimum different speeds.

Wafers were prepared which had an oxide film formed by plasma CVD. By using the polishing machine shown in FIG. 1, plasma oxide films were subjected to chemical mechanical polishing (CMP) and polishing cloths were dressed, under various conditions. The polishing time, lapping nature dressing time, and brushing dressing time were evaluated.

Plasma oxide film forming conditions:
- Gas: TEOS+$O_2$
- Flow rate: TEOS=70 sccm, $O_2$=300 sccm
- RF power: 500 W
- Temperature: 400° C.

CMP conditions:
- Load: 350 g/cm$^2$
- Rotation speed: 30 rpm for both platen and wafer holder
- Type of dresser: diamond disk conditioner, nylon brush
- Components of slurry (polishing agent): colloidal fumed silica-aqueous slurry (containing de-ionized water, silica and potassium hydroxide)
- Slurry dispensing amount: 200 cc/min
- Polishing cloth: IC1000/SUBA400, RODEL CORP 1st conditions: Three processes were separately executed, including a) a polishing process by CMIP, b) a lapping nature dressing process by a diamond disk conditioner, and c) a brushing dressing process by a nylon brush (three-step processes). The time of each process is shown below.

| | |
|---|---|
| a) polishing time: | 3 minutes |
| b) lapping nature dressing time: | 2 minutes |
| c) brushing dressing time: | 2 minutes |
| Total: | 7 minutes |

2nd conditions: The b) and c) processes were executed at the same time by using dressing tools shown in FIG. 5 (two-step processes). The process a) is a polishing process by CMP, and the process b) is a dressing process using a diamond disk conditioner and a nylon brush. Tile time of each process is shown below.

| | |
|---|---|
| a) polishing time: | 3 minutes |
| b) dressing time: | 2 minutes |
| Total: | 5 minutes |

3rd conditions: The polishing process by CMP and the dressing process using the dressing tools shown in FIG. 5 were executed at the same time (one process). The process time (polishing and dressing) was:

2 minutes and 40 seconds The process times shortened in the order of 3rd, 2nd, and 1st conditions. It was confirmed that the total process time could be shortened by executing a plurality of processes at the same time. The polishing time for the 1st and 2nd conditions is 3 minutes, whereas the total process time (polishing time) for the 3rd conditions is 2 minutes and 40 seconds which is shorter than the polishing time for the 1st and 2nd conditions.

Under the 1st conditions, the process times for the b) lapping nature dressing and for the c) brushing dressing are both 2 minutes. Under the 2nd conditions, the process time for the b) dressing is 2 minutes. Under the 3rd conditions, the total process time (dressing time) is 2 minutes and 40 seconds which is shorter than the dressing time under the 1st and 2nd conditions. Sufficient dressing can be performed under the 3rd conditions.

The present invention has been described in connection with the preferred embodiments. The invention is not limited only to the above embodiments. It is apparent that various modifications, improvements, combinations, and the like can be made by those skilled in the art.

I claim:

1. A method of polishing a subject, comprising the steps of:

a) providing the subject retained by a first holder;

b) providing a dresser means having different dressing portions provided coaxially and retained by a second holder, the different dressing portions being disposed in different annular regions, each reaction including only one of the dressing portions;

c) polishing the subject by causing the subject to be held in contact with a polishing cloth provided on a platen; and d) dressing the polishing cloth by causing the dresser means to be held in contact therewith.

2. A method according to claim 1, wherein the second holder swings during the step d).

3. A method according to claim 1, wherein the different dressing portions comprise a first dressing portion of lapping nature and a second dressing portion of brushing nature.

4. A method according to claim 1, wherein the subject and the dresser means are coaxially provided.

5. A method according to claim 1, wherein the steps c) and d) are performed simultaneously.

6. A method according to claim 1, wherein the step c) is performed with providing a slurry on the polishing cloth.

7. A method according to claim 1, wherein the different dressing portions have different nature from each other.

8. A method according to claim 1, wherein the different dressing portions are made of different material from each other.

9. A polishing machine comprising:

a platen having a polishing cloth adhered thereto and being rotatable;

holding means for holding a subject to be polished and pressing the subject against the polishing cloth of the platen under rotation; and dressing means for holding a dresser and pressing the dresser against the polishing cloth of the platen under rotation while rotating the dresser, the dresser having different dressing tools disposed concentrically, the different dressing tools rotating in different annular regions.

10. A polishing machine according to claim 9, wherein said dressing means rotates and swings the dresser while pressing the dresser against the polishing cloth.

11. A polishing machine according to claim 9, wherein while the subject is polished with the polishing cloth of the platen under rotation, the polishing cloth is dressed by pressing the different dressing tools against the polishing cloth.

12. A polishing machine according to claim 9, wherein said dressing means has a dressing tool of lapping nature and a dressing tool of brushing or surface cleaning nature.

13. A polishing machine according to claim 9, further comprising polishing agent supply means for supplying polishing agent to the polishing cloth.

14. A polishing machine according to claim 9, wherein the axis about which the holding means rotates the subject and the axis about which the dressing means rotates the dresser, are coaxial.

15. A polishing machine according to claim 9, wherein the different dressing tools have different nature from each other.

16. A polishing machine according to claim 9, wherein the different dressing tools are made of different material from each other.

17. A polishing machine comprising:

a platen having a polishing cloth adhered thereto and being rotatable;

holding means for holding a subject to be polished and pressing the subject against the polishing cloth of the platen under rotation; and dressing means for holding a dresser and pressing the dresser against the polishing cloth of the platen under rotation while rotating the dresser, the dresser having different dressing tools disposed concentrically, and said dressing means rotating the different dressing tools independently from each other.

* * * * *